United States Patent [19]

Marsh et al.

[11] 4,434,353

[45] Feb. 28, 1984

[54] FUSING SYSTEM

[75] Inventors: Dana G. Marsh, Fairport; David R. Shuey, Webster; John L. Webb, Fairport, all of N.Y.

[73] Assignee: Xerox Corporation, Stamford, Conn.

[21] Appl. No.: 306,985

[22] Filed: Sep. 30, 1981

[51] Int. Cl.[3] ..... G03G 15/20; H05B 3/42

[52] U.S. Cl. ..... 219/216; 355/3 FU; 219/388

[58] Field of Search ..... 219/216, 388, 469, 470, 219/471, 483, 486; 432/227; 250/317.1, 318, 319; 355/3 FU

[56] References Cited

U.S. PATENT DOCUMENTS

| | | | |
|---|---|---|---|
| 2,990,278 | 6/1961 | Carlson | 219/216 |
| 3,465,203 | 9/1969 | Galster . | |
| 3,474,223 | 10/1969 | Leiga | 219/216 |
| 3,745,307 | 7/1973 | Peek | 219/216 |
| 3,832,524 | 8/1974 | Takiguchi | 219/216 |
| 4,075,455 | 2/1978 | Kitamura | 219/216 |
| 4,161,644 | 7/1979 | Yanagawa | 219/483 |
| 4,205,220 | 5/1980 | O'Brien | 219/216 |

FOREIGN PATENT DOCUMENTS

| | | | |
|---|---|---|---|
| 2505416 | 8/1976 | Fed. Rep. of Germany | 355/3 FU |
| 54-126547 | 10/1979 | Japan | 355/3 FU |
| 54-126548 | 10/1979 | Japan | 355/3 FU |

*Primary Examiner*—B. A. Reynolds
*Assistant Examiner*—Teresa J. Walberg
*Attorney, Agent, or Firm*—H. Fleischer; J. E. Beck; R. Zibelli

[57] ABSTRACT

An apparatus which includes a plurality of heating elements to fuse a powder image onto a copy sheet. Selected heating elements of the apparatus are energized in an ordered sequence corresponding to the surface area of the powder image being fused.

8 Claims, 3 Drawing Figures

10
12
14
16
18
20
22
24
26
28
30
32
34
36
38
40
42
44
46
48
50
52
54
58
60
62
64
A
B
C
D
E
F

POWER SUPPLY
84
112
110
108
106
104
102
100
78
76
74
72
70
68
66
98
96
94
92
90
88
86
114
SHIFT REGISTER
TIMING & CONTROL
TRIGGER CIRCUIT
82
TIMING CONTROL 56
72
70
68
66
78
76
74
80

FUSING SYSTEM

This invention relates generally to an electrophotographic printing machine, and more particularly concerns an apparatus for fusing particles to a copy sheet.

Generally, the process of electrophotographic printing includes charging a photoconductive member to a substantially uniform potential to sensitize the surface thereof. The charged portion of the photoconductive member is exposed to a light image of an original document being reproduced. This records an electrostatic latent image on the photoconductive member corresponding to the informational areas contained within the original document. After the electrostatic latent image is recorded on the photoconductive member, the latent image is developed by bringing a developer material into contact therewith. This forms a powder image on the photoconductive member which is subsequently transferred to a copy sheet. Finally, the powder image is heated to permanently affix it to the copy sheet in image configuration.

Numerous techniques have been developed for heating the powder image on the copy sheet to permanently affix it thereto. Among these are oven fusing, hot air fusing, hot and cold pressure roll fusing, and flash fusing. In general, it has been found difficult to construct the universal fuser which would be characterized by high efficiency, reliability, a short warmup time and overall ease of control. For example, fusing techniques relying on the application of pressure and heat have inherent problems in that the toner powder image may partially offset onto the roll due to the fluid nature of the toner particles. This results in poor resolution of the copy. Vapor fusing, which typically employs a toxic solvent, is commercially undesirable due to its odor. Flash fusing has been found to be desirable since it is very efficient at slower intermediate reproduction speeds, while still being suitable for high speed copying. In addition, a flash fuser does not require a long warmup time. Hereinbefore, much of the radiant energy from the flash fuser was wasted in that it was reflected away from the fusing area or on areas not required to be fused. Furthermore, it has been difficult to produce highly uniform radiation over the large copy surface. Considerable effort has been expended to improve flash fusing systems. The following disclosures appear to be relevant:

U.S. Pat. No. 3,465,203
Patentee: Galster et al.
Issued: Sept. 2,1969

U.S. Pat. No. 3,474,223
Patentee: Leiga et al.
Issued: Oct. 21, 1969

U.S. Pat. No. 3,832,524
Patentee: Takiguchi
Issued: Aug. 27, 1974

U.S. Pat. No. 4,075,455
Patentee: Kitamura et al.
Issued: Feb. 21, 1978

U.S. Pat. No. 4,205,220
Patentee: O'Brien
Issued: May 27, 1980

Japanese Laid-Open No. 54-126548
Laid-Open Date: Oct. 1, 1979
Application No. 53-34349
Application Date: Mar. 25, 1978

The relevant portions of the above-identified art may be briefly summarized as follows:

Galster et al., Leiga et al. and O'Brien all disclose Xenon flash lamps used in a fuser of an electrophotographic printing machine for permanently affixing a toner powder image to a copy sheet.

Takiguchi describes a copying machine having a heating unit including a central heating element and two end heating elements. A switch connects the central and two end heating elements in parallel across a voltage source when the larger of two different width copy sheets is used. The switch disconnects the two end heating elements from the voltage source when the smaller of two different width copy sheets is used.

Kitamura et al. discloses a fusing device having a plate and a heater disposed transversely of the plate. The heater is divided into heater sections in the direction of the width of the copy sheet. A temperature sensor controls the power to each of the heater sections. The power furnished to the heating elements depends upon the width of the copy sheet.

The Japanese publication describes a fusing device having a plurality of flash lamps to reduce the voltage required for each lamp.

In accordance with one aspect of the features of the present invention, there is provided an apparatus for fusing a powder image onto a copy sheet. The apparatus includes a plurality of heating elements. Means are provided for energizing selected ones of the plurality of heated elements in an ordered sequence so as to permanently affix the powder image to the copy sheet.

Pursuant to another aspect of the features of the present invention, there is provided an electrophotographic printing machine of the type having a toner powder image formed on a copy sheet. The improved apparatus for fusing the toner powder image to the copy sheet includes a plurality of heating elements. Means are provided for energizing selected ones of the plurality of heating elements in an ordered sequence so as to permanently affix the toner powder image to the copy sheet.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
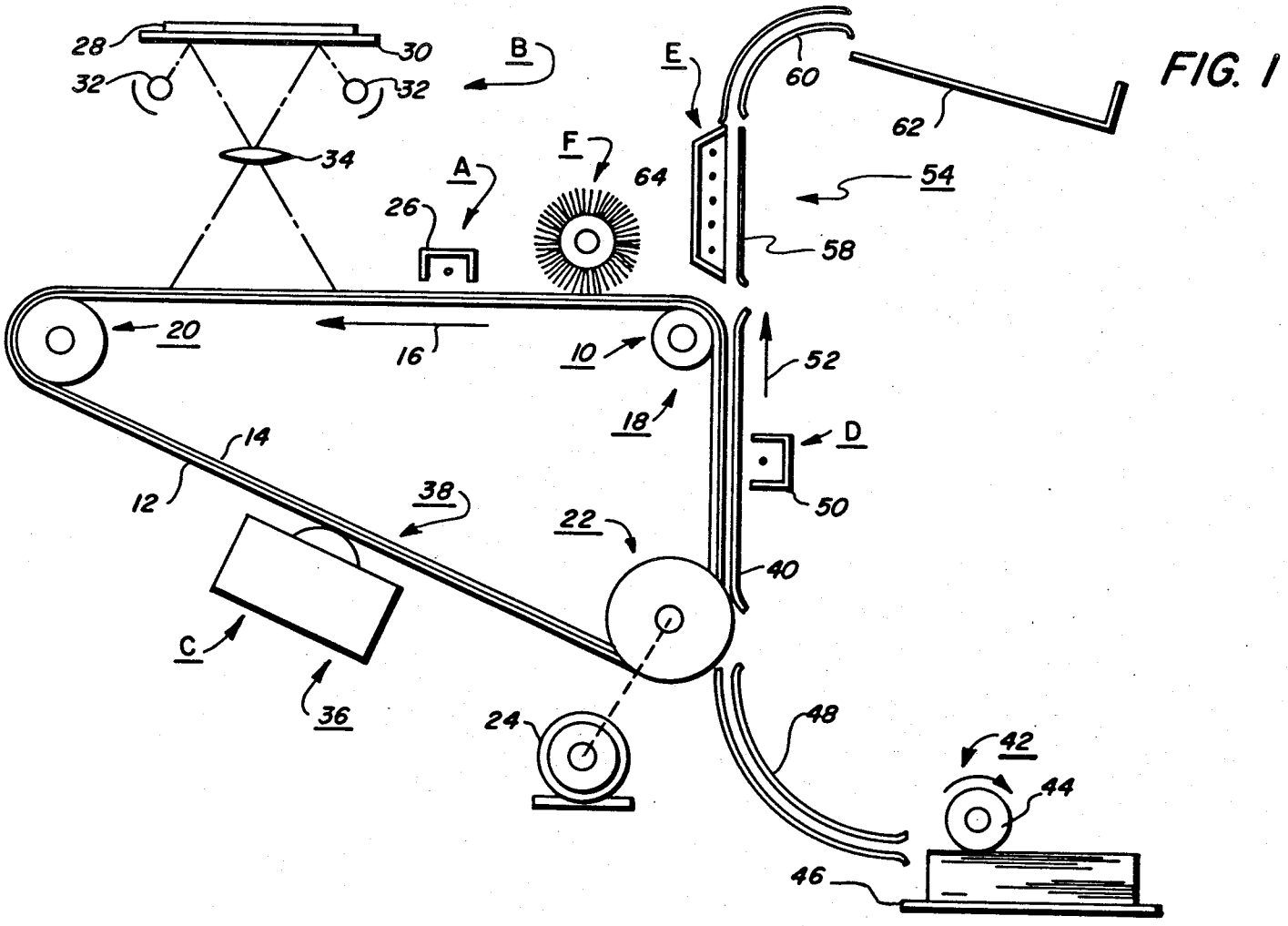
FIG. 1 is a schematic elevational view showing an illustrative electrophotographic printing marchine incorporating the features of the prsent invention therein.

Turning now to FIG. 1, the electrophotographic printing machine employs belt 10 having a photoconductive surface 12 deposited on a conductive substrate. Preferably, photoconductive surface 12 is made from a selenium alloy with conductive substrate 14 being an electrically grounded aluminum alloy. Other suitable photoconductive surfaces and conductive substrates may also be employed. Belt 10 moves in the direction of arrow 16 to advance successive portions of photoconductie surface 12 through the various processing stations disposed about the path of movement thereof. As shown, belt 10 is entrained about a stripping roller 18, tension roller 20 and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as a drive belt. Drive roller 22 includes a pair of opposed spaced edge guides. The edge guides define a space therebetween which determines the desired path of movement of belt 10. Belt 10 is maintained in tension by a pair of springs (not shown) resiliently urging tension roller 20 against belt 10 with the desired spring force. Both stripping roller 18 and tension roller 20 are mounted rotatably. These rollers are idlers which rotate freely as belt 10 moves in the direction of arrow 16.

With continued reference to FIG. 1, initially a portion of belt 10 passes through charging station A. At charging station A, a corona generating device, indicated generally by the reference numeral 26, charges photoconductive surface 12 of belt 10 to a relatively high, substantially uniform potential.

Next, the charged portion of photoconductive surface 12 is advanced through exposure station B. At exposure station B, an original document 28 is positioned facedown upon a transparent platen 30. Lamps 32 flash light rays onto original document 28. The light rays reflected from original document 28 are transmitted through lens 34 forming a light image thereof. Lens 34 focuses the light image onto the charged portion of photoconductive surface 12 to selectively dissipate the charge thereon. This records an electrostatic latent image corresponding to the informational areas contained within the original document on photoconductive surface 12. Thereafter, belt 10 advances the electrostatic latent image recorded on photoconductive surface 12 to development station C.

At development station C, a magnetic brush development system, indicated generally by the reference numeral 36, transports the developer material of carrier granules and toner particles into contact with photoconductive surface 12. Magnetic brush development system 36 includes a developer roller 38 which advances a brush of developer material into contact with photoconductive surface 12. The toner particles are attracted from the carrier granules to the electrostatic latent image forming a toner powder image on photoconductive surface 12 of belt 10.

After development, belt 10 advances the toner powder image to transfer station D. At transfer station D, a sheet of support material 40 is moved into contact with the toner powder image. The sheet of support material is advanced to transfer station D by sheet feeding apparatus 42. Preferably, sheet feeding apparatus 42 includes a freed roll 44 contacting the uppermost sheet of stack 46. Feed roller 44 rotates to advance the uppermost sheet from stack 46 into chute 48. Chute 48 directs the advancing sheet of support material into contact with photoconductive surface 12 of belt 10 in a timed sequence so that the toner powder image developed thereon contacts the advancing sheet of support material at transfer station D.

Transfer station D includes corona generating device 50 which sprays ions onto the back side of sheet 40. This attracts the toner powder image from photoconductive surface 12 to sheet 40. After transfer, the sheet continues to move in the direction of arrow 52 onto a conveyor (not shown) which advances the sheet to fusing station E.

Fusing station E includes a fuser assembly, indicated generally by the reference numeral 54, which permanently affixes the transferred toner powder image to sheet 40. Fuser assembly 54 includes an upper housing having a plurality of flash lamps disposed therein, and a lower housing 58 comprising a belt conveyor for advancing sheet 40 therethrough. In this manner, the toner powder image is permanently affixed to sheet 40. The detailed structure of fuser assembly 54 will be described hereinafter with reference to FIGS. 2 and 3. After fusing, chute 60 guides the advancing sheet 40 to catch tray 62 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a preclean corona generating device (not shown) and a rotatably mounted fibrous brush 64 in contact with photoconductive surface 12. The preclean corona generating device neutralizes the charge attracting the particles to the photoconductive surface. These particles are then cleaned from the photoconductive surface by the rotation of brush 64 in contact therewith. Subsequent to cleaning, a discharge lamp (not shown) floods photoconductive surface 12 with light to dissipate any residual charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
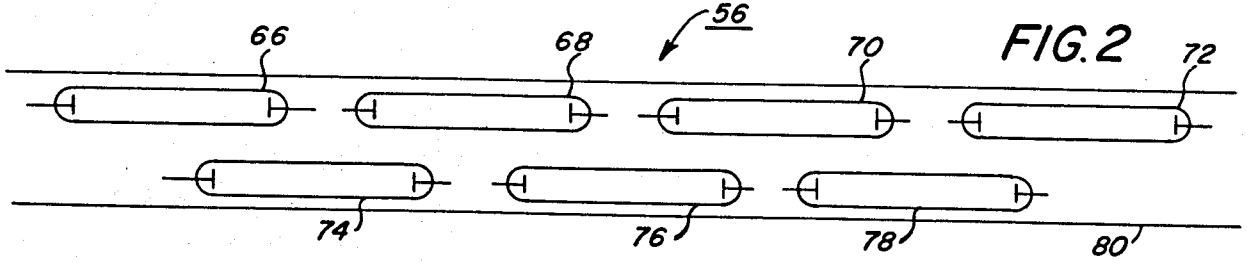
FIG. 2 is an elevational view depicting a portion of the fuser used in the FIG. 1 printing machine.

Referring now to FIG. 2, there is shown fuser assembly 54 in greater detail. As depicted thereat, upper housing 56 includes seven flash lamps, designated by the reference numerals 66, 68, 70, 72, 74, 76 and 78. Reflector 80 is a specular rectangular reflector having an aperture ranging from about 1 inch (2.54 centimeters) to 1.5 inches (3.81 centimeters). The interior surface of reflector 80 has a continuously uniform white coating applied thereon. Preferably, this coating is a white enamel paint sprayed thereon and capable of withstanding high temperatures, i.e. ranging from about 500° F. to about 1200° F. Preferably, each of the flash lamps is about 3 inches (7.62 centimeters) long. Each flash lamp may comprise a coarse tube filled with a suitable gas, for example, Xenon gas, and contains two electrodes, one sealed at each end thereof. The flash lamps provide a 1.6 millisecond light pulse for fusing toner particles deposited on a copy sheet. Each of the flash lamps preferably is at a distance ranging from about 0.125 inch (0.2175 centimeters) to about 0.375 inch (0.9525 centimeters) from the surface of the toner powder image. A ripple flash fusing concept is employed. Thus, lamps 66 through 78, inclusive, are triggered simultaneously but fired individually in succession. The distance between lamps 66 and 72 corresponds to the width of a 14 inch (35.56 centimeter) sheet of paper. Thus, lamps 66, 74, 68, 76, 70, 78, and 72 are energized in succession. However, if the copy sheet is 11 inches (27.94 centimeters), lamps 66 and 72 remain de-energized. For an 11 inch (27.94 centimeter) size copy sheet, lamps 74, 68, 76, 70 and 78 are energized in succession. The radiant energy from each of the flash lamps individually is insufficient to fuse the toner powder image to the copy sheet. However, the radiant energy developed by the multiple flashes produces a cumulative effect resulting in permanently affixing the toner powder image to the copy sheet.

Figure 3:
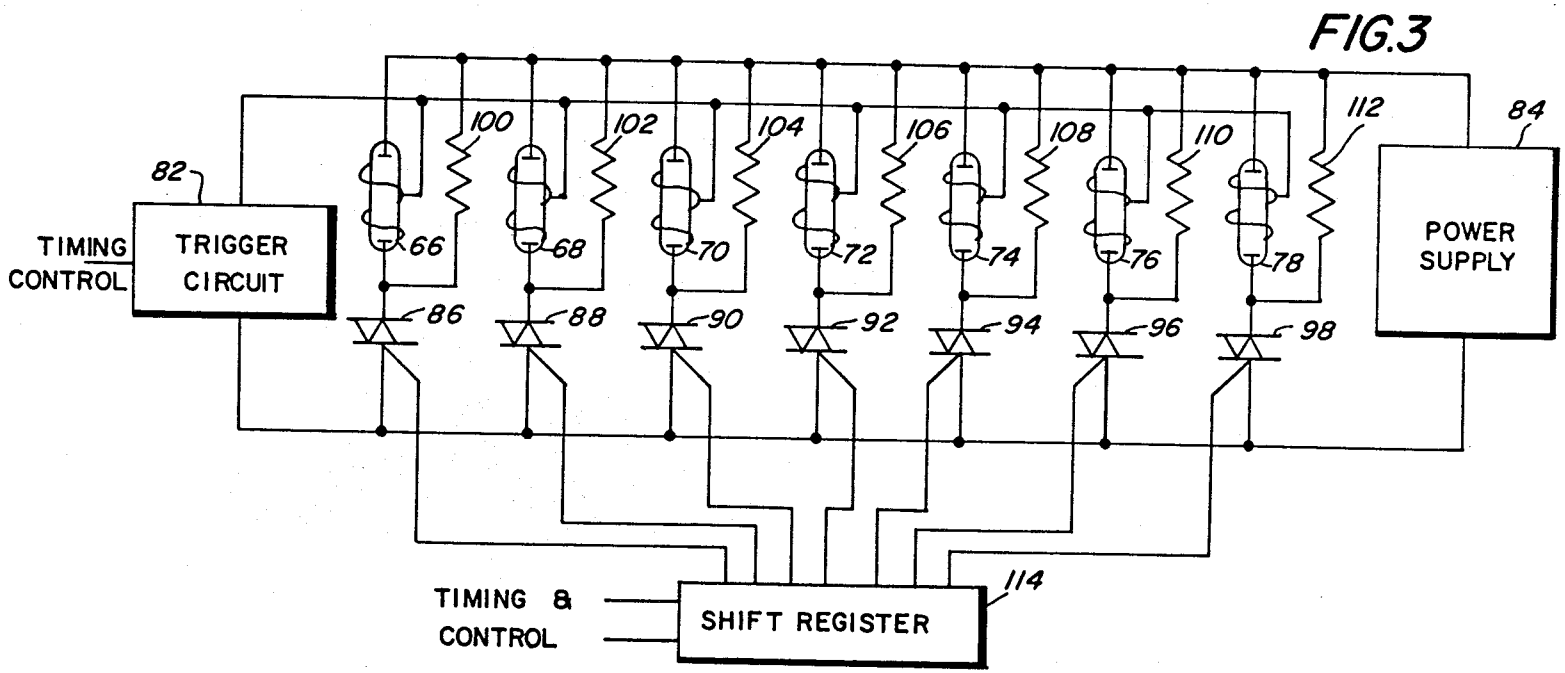
FIG. 3 is a schematic diagram illustrating the circuitry for controlling the energization of the FIG. 2 fuser.

Referring now to FIG. 3, a trigger coil encloses the tube of each flash lamp intermediate the electrodes thereof. The coil is coupled to a suitable trigger circuit 82, such as a relay circuit or controlled rectifier circuit, which, when activated, provides a suitable high voltage pulse to the trigger coil. This pulse through the coil generates a high field in the lamp between the electrodes to which is applied a voltage difference from power supply 84, thereby causing the gas in the tube to ionize a conductive arc between the flash lamps electrodes. Power supply 84 provides a suitable voltage to cause ionization of the gas in the flash lamp tube. The flash lamps emit radiant energy therefrom to achieve the desired degree of fusion between the toner powder image and the copy sheet.

As shown in FIG. 3, lamps 66, 68, 70, 72, 74, etc. are connected in parallel with power supply 84 and trigger circuit 82. The timing for trigger circuit 82 is furnished from the printing machine controller (not shown). Alternatively, a dedicated circuit could be associated with trigger circuit 82 for providing timing therefore. Triacs 86, 88, 90, 92, 94, 96 and 98 associated with their corresponding flash lamps 66, 68, 70, 72, 74, 76 and 78 are in series therewith and of a fixed value. Resistors 100, 102, 104, 106, 108, 110 and 112 are associated with their respective flash lamps 68, 70 72, 74, 76 and 78. Each resistor is in parallel with its corresponding lamp and is of a selected value to allow the respective triac to begin to conduct before the lamps are triggered. This tends to minimize the criticality of timing between the trigger circuit and the gate signals. Shift register 114 is coupled to each of the triacs. In addition, the printing machine controller provides the timing and control for shift register 114 to activate successive triacs in an ordered sequence. Thus, shift register 114 permits cycling of the lamps in a ripple fashion, i.e. energization of lamps 66, 74, 68, 76, 70, 78, and 72 in succession. In addition, when the controller indicates that an 11 inch (27.94 centimeter) sheet of paper rather than a 14 inch (35.56 centimeter) sheet of copy paper is being employed, shift registor 114 will not energize lamps 66 and 72. The number of flash lamps energized is sufficient to generate radiant energy corresponding in size to the surface area of the copy sheet so as to fuse the toner powder image thereto.

One skilled in the art will appreciate that it is not necessary to sequentially activate adjacent flash lamps but any other ordered sequence may also be achieved by the system of the present invention.

The features of the present invention are particularly suited to detecting the area of the toner powder image on the copy sheet, and, in response thereto, selectively activating the lamps of the fuser to permanently affix the powder image thereto. For example, a single character deposited as a powder image in the central region of a 14 inch (35.56 centimeter) copy sheet may only require the energization of a single centrally located lamp to be fused thereto. In this way, fusing of undesired powder particles to the copy sheet is avoided.

In recapitulation, it is clear that the fusing apparatus of the present invention sequentially activates successive heating elements to permanently affix a toner powder image to a copy sheet. Each heating element is a flash lamp which may be coupled to a power supply, trigger circuit and shift registor in order to be energized at the appropriate time. Furthermore, selected flash lamps may remain de-energized so that the radiant energy generated by the heating elements corresponds in size to the surface area of the copy sheet passing therethrough, or to the surface area of the powder image formed thereon.

It is, therefore, evident that there has been provided in accordance with the present invention, an apparatus for permanently fusing toner particles to a copy sheet. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. As apparatus for fusing a powder image onto a copy sheet, including:

a plurality of heating elements; and means, responsive to the size of the copy sheet, for energizing selected ones of said plurality of heating elements in an ordered sequence to produce a radiant energy output therefrom corresponding in surface area to substantially about the surface area of the copy sheet to heat the powder image on the copy sheet so as to permanently affix the powder image thereto.

2. An apparatus according to claim 1, wherein each of said plurality of heating elements includes a flash lamp.

3. An apparatus according to claim 3, wherein said energizing means includes:

a voltage source; and means for controlling said voltage source to supply electrical power to the selected ones of said plurality of flash lamps to energize the selected ones of said plurality of flash lamps in an ordered sequence to produce radiation of sufficient intensity to fix the powder image to the copy sheet.

4. An apparatus according to claim 3, wherein said controlling means controls said voltage source to supply electrical power to successive adjacent ones of said plurality of flash lamps with the number of said plurality of flash lamps being supplied with electrical power being sufficient to generate radiant energy having a surface area corresponding to the size of the copy sheet.

5. An electrophotographic printing machine of the type having a toner powder image formed on a copy sheet, wherein the improved apparatus for fusing the toner powder image to the copy sheet includes:

a plurality of heating elements; and means, responsive to the size of the copy sheet, for energizing selected ones of said plurality of heating elements in an ordered sequence to produce a radiant energy output therefrom corresponding in surface area to substantially about the surface area of the copy sheet to heat the toner powder image on the copy sheet so as to permanently affix the toner powder image thereto.

6. A printing machine according to claim 5, wherein each of said plurality of heating elements includes a flash lamp.

7. A printing machine according to claim 6, wherein said energizing means includes:

a voltage source; and means for controlling said voltage source to supply electrical power to the selected ones of said plurality of flash lamps to energize the selected ones of said plurality of flash lamps in an ordered sequence to produce radiation of sufficient intensity to fix the toner powder image to the copy sheet.

8. A printing machine according to claim 7, wherein said controlling means controls said voltage source to supply electrical power to successive adjacent ones of said plurality of flash lamps with the number of said plurality of flash lamps being supplied with electrical power being sufficient to generate radiant energy having a surface area corresponding to the size of the copy sheet.

* * * * *